United States Patent [19]

Ottestad

[11] Patent Number: 4,711,263

[45] Date of Patent: Dec. 8, 1987

[54] DOUBLE-ACTING VALVE SYSTEM FOR UNDERWATER BREATHING OR THE LIKE

[75] Inventor: Nils T. Ottestad, Lyngun 27, 3100 Tønsberg, Norway

[73] Assignees: Nils T. Ottestad, Tønsberg; Den Norske Stats Oljeselskap A.S., Stavenger, both of Norway

[21] Appl. No.: 907,102

[22] Filed: Sep. 15, 1986

[30] Foreign Application Priority Data

Sep. 18, 1985 [NO] Norway ..... 853654

[51] Int. Cl.[4] ..... A62B 7/04

[52] U.S. Cl. ..... 137/102; 128/204.26; 137/630.13

[58] Field of Search ..... 128/204.26; 137/102, 137/630.13, 630.14

[56] References Cited

U.S. PATENT DOCUMENTS

| | | | |
|---|---|---|---|
| 915,467 | 3/1909 | McCutcheon | 137/630.13 |
| 3,498,312 | 3/1970 | Geiszler . | |
| 3,595,226 | 7/1971 | Newcombe | 128/204.26 |

FOREIGN PATENT DOCUMENTS

| | | | |
|---|---|---|---|
| 0073887 | 6/1982 | European Pat. Off. . | |
| 151447 | 1/1985 | Norway | 128/204.28 |
| 976657 | 12/1964 | United Kingdom . | |
| 1064732 | 5/1967 | United Kingdom . | |
| 1548430 | 7/1979 | United Kingdom . | |
| 203515A | 6/1980 | United Kingdom . | |

*Primary Examiner*—Robert G. Nilson

*Attorney, Agent, or Firm*—Hopgood, Calimafde, Kalil, Blaustein & Judlowe

[57] ABSTRACT

A valve for regulating the through-flow of a fluid from an inlet (10) to an outlet (11), especially for regulating a gas flow from a place (4) with a higher pressure than the ambient pressure, the valve (2) being arranged to be opened by an operating means (22) which is mechanically coupled to a means sensing the pressure at said place (4). The valve comprises a piston (7) which is slidable in a piston guide (8), a sealing seat (12) for the piston (7) being provided at the end of the piston guide (8) facing away from the place (4) with higher pressure. The other end (14) of the piston guide (8) is closed and together with an adjacent end face (15) of the piston (7) define a chamber (16). A pressure equalizing channel (17) is provided between the chamber (16) and the outlet side (11) of the valve, and a control valve (18, 19) is arranged to close and open the pressure equalizing channel (17) by means of said operating means (22) which is arranged to move the piston (7) away from its seat (12) only after having opened the control valve (18, 19).

4 Claims, 2 Drawing Figures

DOUBLE-ACTING VALVE SYSTEM FOR UNDERWATER BREATHING OR THE LIKE

BACKGROUND OF THE INVENTION

The present invention relates to a valve for regulating the through-flow of a fluid from an inlet to an outlet, especially for regulating a gas flow from a place with a higher pressure than the ambient pressure, the valve being arranged to be opened by an operating means which is mechanically coupled to a means sensing the pressure at said place. Further, the invention relates to a double-acting valve device including such a valve, especially a breathing valve for divers wherein the valve constitutes an exhalation valve.

A topical field of application for such a regulating valve is in breathing systems for divers. Such systems for the supply of breathing gas are generally based on regulated supply from reservoirs of high-pressure gas. Usually, the through-flow of gas is controlled in such a manner that it corresponds to the demand, i.e. the system is a so-called demand system.

From Norwegian Patent Specification No. 151,447 there is known a gas regulator valve which is designed as an inhalation valve, which valve affords a precise control with a minimum of force consumption in the opening of the valve. The known valve is regulated by axial displacement of a piston, the pressure difference on the two end faces of the piston being equalized by means of a control valve which opens for a pressure equalizing channel through the piston. The piston is mounted in a cylindrical guide of which one end has a contriction acting as a sealing surface/seat for the piston, and of which the other end is closed. The valve is in closed position when the piston with one end face rests against said sealing surface/seat and the pressure equalizing channel is closed. The gas flow through the valve is via channels through the wall of the cylindrical guide and further through the constriction in the guide.

The cylindrical piston guide, one end face of the piston and the closed end portion of the piston guide define a chamber which is of fundamental importance for the gas regulation, the chamber together with the pressure equalizing channel making it possible to obtain approximately the same gas pressure on both sides of the piston before this is moved to open position, so that the gas flow can be regulated with a small force. The force which is necessary to move the piston with the pressure equalizing channel closed, typically may be of the order of 20 times larger than with the channel open.

The known valve according to said Norwegian patent specification generally can be used for maintaining a stable secondary pressure. This is of topical interest for example in a common sports diver valve wherein one wants the diver to be supplied with gas of the same pressure as the pressure of the surrounding water. However, this valve structure cannot be used for regulating exhaled gas. The valve is then wanted to "draw out" gas as soon as the pressure in the valve housing exceeds the surrounding pressure. In this situation, the primary pressure is synonymous with the pressure in the valve housing. The valve must try to keep this pressure constant. Such a valve may be called a "back-pressure" valve. A traditional regulating valve has for its task to provide for supplying gas when this is required in order to maintain a stable pressure in the valve housing (=the ambient pressure). The back-pressure valve shall, on its part, provide for letting out gas when this is required for maintaining the pressure.

BRIEF STATEMENT OF THE INVENTION

The primary object of the present invention to is to provide a valve of the back-pressure type, i.e. a valve letting out fluid, especially gas, when this is required for maintaining a primary pressure, wherein the valve can regulate the through-flow of large fluid quantities in a precise manner and with a minimum of force.

A further object of the invention is to provide a double-acting valve device having such a "back-pressure" valve, especially a breathing valve for divers wherein the valve constitutes an exhalation valve, and wherein the gas regulation is precise and requires only a small force.

According to the invention there is provided a valve of the type stated in the introduction and which is characterized in that the valve, as known per se, comprises a valve body in the form of a main piston which is slidably arranged in a piston guide, a sealing seat for the piston being provided at the end of the piston guide facing away from said place, the other end of the piston guide being closed and defining, together with an end surface of the piston, a chamber communicating through a narrow passage with the outlet side, and that the piston is provided with a pressure equalizing channel between the chamber and the outlet side, a control valve being arranged to close and open the channel by said operating means which is arranged to move the piston away from its seat only after having opened said control valve.

Further, in accordance with the invention, there is provided a double-acting valve device as well as an inhalation valve operating according to the same regulating principle are coupled through respective operating rods and a linkage to a common sensing diaphragm sensing and responding to the pressure in a valve housing, the two valves being oppositely oriented in relation to the valve housing, the operating rod of the exhalation valve being carried through the closed end portion of the piston guide of the valve, whereas the operating rod of the inhalation valve is carried through the main piston of this valve.

DETAILED DESCRIPTION

Figure 1:
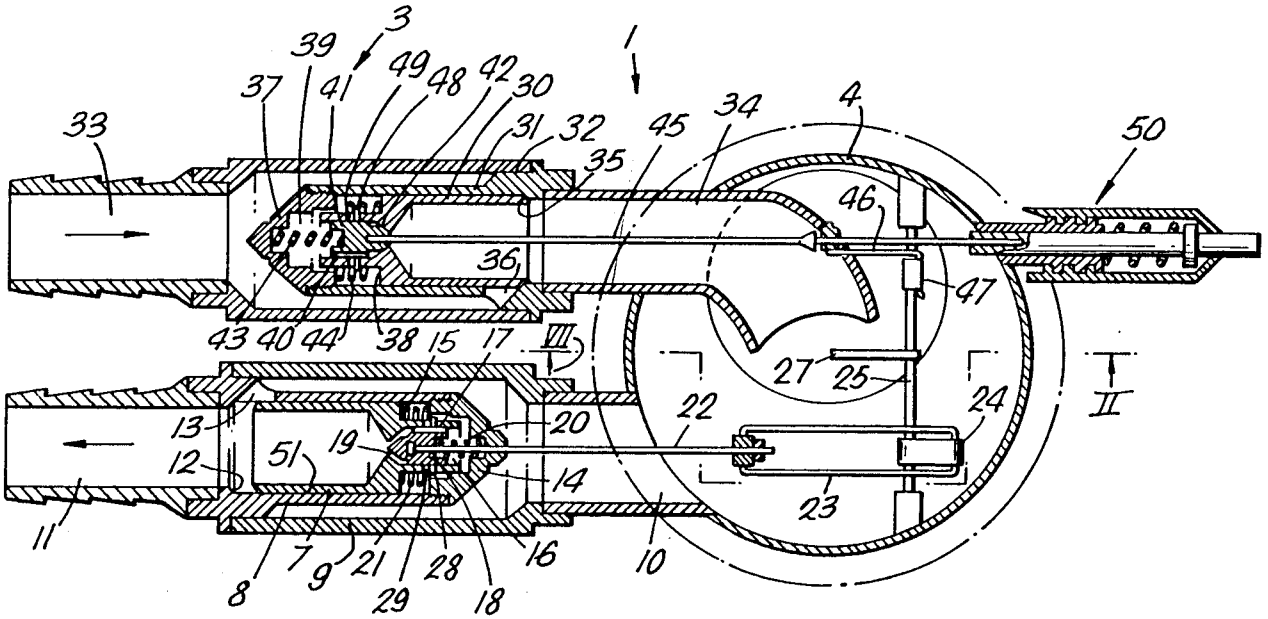
Figure 2:
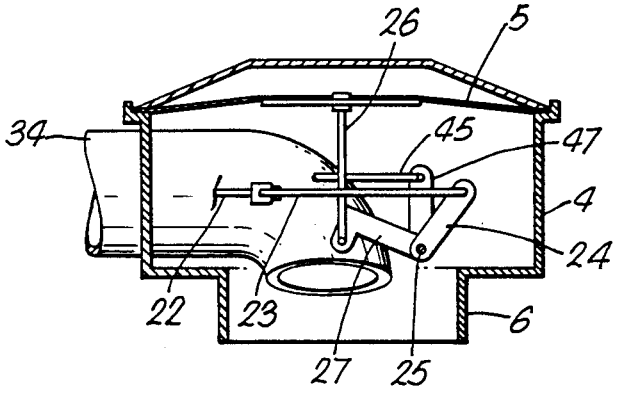

The invention will be further described below in connection with an illustrated embodiment with reference to the accompanying drawings, wherein FIG. 1 is a longitudinal sectional view of a double-acting breathing valve device including a valve according to the invention; and FIG. 2 is a partial section essentially along the line II—II in FIG. 1.

In FIG. 1 there is shown a double-acting demand breathing valve (demand regulator) 1 including an exhalation valve 2 according to the invention and an inhalation valve 3 which are both coupled to a common valve housing 4 wherein there is mounted a sensing diaphragm 5 (FIG. 2) sensing and responding to the pressure in the valve housing. The diaphragm is common to both valves 2, 3 and is arranged to operate these valves through a linkage and the respective operating means of the valves, which means are constituted by operating or control rods, as further described below. The valves are in a closed position when the diaphragm 6 is in an intermediate position. As shown in FIG. 2, the valve housing 4 has a connecting tube 6 for connection to the diver's breathing mouthpiece or breathing mask (not shown).

The exhalation valve 2 comprises a main piston 7 which is axially displaceable in a sleeve-shaped piston guide 8 which in turn is mounted in an outer valve housing 9 having an inlet 10 and an outlet 11. One end of the piston guide 8 has a constriction forming a valve seat 12 for a correspondingly ground end face of the main piston 7. At this end the piston guide is provided with ports 13 for through-flow of gas in an open position of the valve. At its other end the piston guide 8 is closed by means of a threaded cap 14, and between this cap and the adjacent end face 15 of the piston 7 there is formed a chamber 16 communicating with the outlet side 11 of the valve through a pressure equalizing channel 17 formed through the piston 7. The pressure equalizing channel 17 can be opened and closed by means of a control valve comprising a valve body in the form of a control piston 18 which is displaceable in the channel 17 and cooperates with a seat 19 in the main piston 7. In the chamber 16 there is arranged a weak helical spring 20 pushing the control valve body 18 towards the closed position in abutment against the seat 19, and and additional weak helical spring 21 pushing the main piston 7 towards the closed position in abutment against the seat 12. These springs ensure a quick closing of the valve.

As mentioned, the valve 2 is arranged to be opened and closed by means of an operating or control rod 22 which is carried axially through the cap 14 forming the right end face in the chamber 16. The rod is connected at one end to the valve body 18 of the control valve, and at its other end the rod is coupled to the sensing diaphragm 5 through said linkage. The linkage comprises a link arm or stirrup 23 between the control rod and an arm 24 which is fixed to a transverse shaft 25 in the valve housing 4. The diaphragm 5 centrally is provided with a depending arm 26 which is coupled to the shaft 25 through a main transfer arm 27.

As appears from FIG. 1, the valve body 18 of the control valve has axial lost-motion connection to the main piston 7; as shown, the lost-motion connection involves a pair of protruding pins carried by valve body 18 and extending into short axial slots 29 in the main piston 7. This arrangement results in that the control rod 22, when moving to the right, firstly opens the control valve 18, 19, and that the valve body 18 thereafter, by further movement of the control rod to the right, brings along the main piston 7 and thereby opens the valve 2 when the protruding pins 28 are brought into engagement with the main piston at the ends of the slots 29.

In manner corresponding to that of the exhalation valve 2, the inhalation valve 3 includes a main piston 30, a piston guide 31, a valve housing 32 having an inlet 33 and an outlet 34, a valve seat 35 for the main piston 30, ports 36 in the piston guide 31 for through-flow of gas, a cap 37 closing the piston guide, a chamber 39 defined between the cap 37 and the adjacent end face 38 of the piston 30, a pressure equalizing channel 40 through the piston 30, a control valve comprising a valve body 41 and a valve seat 42, and helical springs 43 and 44 for urging the control valve body 41 and the main piston 30, respectively, towards the closed position.

The inhalation valve 3 is arranged to be opened and closed by means of an operating or control rod 45. However, this rod 45 extends axially through the main piston 30, in contradistinction to the control rod 22 of the exhalation valve, which rod extends through and is guided by the piston guide cap 14; this is because the inhalation valve 3 is controlled from the lowpressure side, whereas the exhalation valve 2 is controlled from the high-pressure side. (The inlet 33 may e.g. be based on an overpressure of 0.1 atm. in relation to the valve housing 4, whereas the outlet 11 e.g. may have negative pressure of 0.1 atm.) Apart from the indicated directional extent of the control rods 22, 45 in relation to their respective valves, the exhalation and inhalation valves are identical, being mounted in opposite directions in relation to the valve housing 4.

The linkage between the control rod 45 of the inhalation valve 3 and the sensing diaphragm 5 comprises a link arm 46 which is connected between the control rod 45 and an arm 47 which is fixed to the transverse shaft 25 in the valve housing 4.

In a manner corresponding to that of the control valve body 18 in the exhalation valve 2, the control valve body 41 in the inhalation valve 3 is provided with a pair of protruding pins 48 inserted in short, axial slots 49 in the main piston 30.

In FIG. 1, the exhalation valve 2 of the demand regulator 1 is shown in open position, the diver being in progress of blowing out. His breathing has created a small overpressure in the valve housing 4, so that the diaphragm 5 has been moved upwards. Accordingly, the main transfer arm 27 has rotated the shaft 25 clockwise, so that the control rod 22 through the arm 24 and the stirrup 23 has been pulled to the right.

The first thing that happens when the diver blows out, is that the valve body 18 of the control valve is pulled away from the seat 19. As a result of the fact that the valve body 18 is moved away from the seat, the pressure equalizing channel 17 between the chamber 16 and the outlet 11 is opened. The pressure difference between the chamber 16 and the outlet is then instantaneously reduced, and the main piston 7 of the exhalation valve can then be moved with a minimum of force, and thereby regulate the throughflow of gas. The chamber 16 receives some gas through a leakage passage 51 between the main piston 7 and the piston guide 8. This leakage is small and is unable to build up the pressure in the chamber 16 as long as the valve body 18 is pulled to the right. The leakage is, however, sufficiently large for the chamber 16 to obtain the same pressure as the valve housing 4 a fraction of a second after the control valve body 18 has returned to its seat.

By pulling the control valve body 18 away from its seat 19 in the main piston 7, the (main part of the) pressure forces attempting to press the main piston 7 against the seat 12, are (is) eliminated. The gas regulation therefore requires a minimum of force.

It will be appreciated that the inhalation valve 3 functions according to exactly the same principle, but it is now a negative pressure in the breathing which causes the sensing diaphragm 5 to be pulled downwards and to bring the shaft 25 to rotate counterclockwise, so that the control rod 45 of the inhalation valve is pushed to the left and controls the inhalation valve.

In FIG. 1 there is also shown a push button means 50 (left out in FIG. 2) which, when depressed, causes supplied gas to flow freely through the inhalation valve 3. This push button may for example be used to push gas into the lungs of an unconscious diver.

Even if the invention in the foregoing has been described in connection with a breathing valve device for divers, it should be understood that the described valves can be used separately for a number of purposes, more specifically for applications where it is wanted to regulate flows of gas or liquids in a precise manner and with a minimum of force.

I claim:

1. A double-acting valve device, especially a demand breathing regulator for divers, comprising a chamber having a flexible diaphragm arranged therein and forming a wall of the chamber, an inhalation valve and an exhalation valve of which each is in communication with said chamber, and operating means including a transmission mechanism interconnecting said diaphragm and said valves, the mechanism being arranged to open the inhalation valve upon movement of said diaphragm inwardly in the chamber from an intermediate position, and to open the exhalation valve upon movement of said diaphragm outwardly in the chamber from said intermediate position, said valve being oppositely oriented in relation to said chamber and each of said valves having an inlet side and an outlet side and being of the type comprising a valve body in the form of a main piston which is slidably arranged in a piston guide, a sealing seat for the piston at one end of the piston guide, and the other end of the piston guide having a closed end portion and defining together with an end face of the piston, a chamber communicating through a narrow passage with the outlet side, the piston being provided with a pressure-equalizing channel between the chamber and the outlet side, and a control valve arranged to close and open said channel by an operating means connected to said transmission mechanism and arranged to move the piston away from its seat only after having opened said control valve, said control valve comprising a piston-shaped valve stem which is slidable in a cylindrical guide in the main piston and cooperates with a seat in said end face of the main piston, and said valve stem being connected to said operating means, and an axial lost-motion connection between said valve stem and the main piston, said lost-motion connection comprising at least one protruding pin carried by said valve stem within a short axial slot in the main piston.

2. A valve according to claim 1, wherein the valve stem of the control valve is bolt-shaped and has a conically shaped tip for cooperation with its seat in the main piston, and wherein the pressure equalizing channel is provided by at least one longitudinally extending groove in the bolt-shaped valve stem.

3. A double-acting valve device especially a demand breathing regulator for divers, comprising a chamber having a flexible diaphragm arranged therein and forming a wall of the chamber, an inhalation valve and an exhalation valve of which each is in communication with said chamber, and operating means including a transmission mechanism interconnecting said diaphragm and said valves, the mechanism being arranged to open the inhalation valve upon movement of said diaphragm inwardly in the chamber from an intermediate position, and to open the exhalation valve upon movement of said diaphragm outwardly in the chamber from said intermediate position, said valves being oppositely oriented in relation to said chamber, and each of said valves having an inlet side and an outlet side and being of the type comprising a valve body in the form of a main piston which is slidably arranged in a main piston guide, a sealing seat for the piston at one end of the piston guide, and the other end of the piston guide having a closed end portion and defining, together with an end face of the piston, a chamber communicating through a narrow passage with the outlet side, the piston being provided with a pressure-equalizing channel between the chamber and the outlet side, and a control valve arranged to close and open said channel by an operating means connected to said transmission mechanism and arranged to move the piston away from its seat only after having opened said control valve, said main piston guide being provided with at least one port for flow of breathing gas when said main piston is moved away from its seat, said control valve comprising a piston-shaped valve stem which is slidable in a cylindrical guide in the main piston and cooperates with a seat in said end face of the main piston, and said valve stem being connected to said operating means, and an axial lost-motion connection between said valve stem and the main piston, the valve stem of the control valve being bolt-shaped and having a conically shaped tip for cooperating with its seat in the main piston, and the pressure equalizing channel being provided by at least one longitudinally extending groove in the bolt-shaped valve stem.

4. A double-acting valve device, especially a demand breathing regulator for divers, comprising a chamber having a flexible diaphragm arranged therein and forming a wall of the chamber, an inhalation valve and an exhalation valve of which each is in communication with said chamber, and operating means including a transmission mechanism interconnecting said diaphragm and said valves, the mechanism being arranged to open the inhalation valve upon movement of said diaphragm inwardly in the chamber from an intermediate position, and to open the exhalation valve upon movement of said diaphragm outwardly in the chamber from said intermediate position, said valves being oppositely oriented in relation to said chamber, and each of said valves having an inlet side and an outlet side and being of the type comprising a valve body in the form of a main piston which is slidably arranged in a piston guide, a sealing seat for the piston guide having a closed end portion and defining, together with an end face of the piston, a chamber communicating through a narrow passage with the outlet side, the piston being provided with a pressure-equalizing channel between the chamber and the outlet side, and a control valve arranged to close and open said channel by an operating means connected to said transmission mechanism and arranged to move the piston away from its seat only after having opened said control valve, said control valve comprising a piston-shaped valve stem which is slidable in a cylindrical guide in the main piston and cooperates with a seat in said end face of the main piston, and said valve stem being connected to said operating means, and an axial lost-motion connection between said valve stem and the main piston, said operating means including for each of said inhalation and exhalation valves, a rod extending axially in relation to said piston, the operating rod of the exhalation valve extending through said closed end portion of said piston guide of the exhalation valve, and the operating rod of the inhalation valve extending through the main piston of the inhalation valve, and the valve stem of the control valve being bolt-shaped and having a conically shaped tip for cooperation with its seat in the main piston, and the pressure equalizing channel being provided by at least one longitudinally extending groove in the bolt-shaped valve stem.

* * * * *